US005447460A

United States Patent [19]

Nakamura et al.

[11] Patent Number: 5,447,460

[45] Date of Patent: Sep. 5, 1995

[54] CATHODE-RAY TUBE DISPLAY UNIT AND METHOD OF MAKING THE SAME

[75] Inventors: Koji Nakamura; Tetsushin Yazu; Suguru Fujii, all of Nagaokakyo; Keitaro Tsukui, Amagasaki; Junko Itoh, Amagasaki; Kenichi Umino, Amagasaki, all of Japan

[73] Assignee: Mitsubishi Denki Kabushiki Kaisha, Tokyo, Japan

[21] Appl. No.: 42,504

[22] Filed: Apr. 5, 1993

[30] Foreign Application Priority Data

Apr. 6, 1992 [JP] Japan ..... 4-084173

[51] Int. Cl.[6] ..... H01J 9/00

[52] U.S. Cl. ..... 445/22; 445/8; 313/477 R

[58] Field of Search ..... 313/477 R; 445/8, 22; 348/822

[56] References Cited

U.S. PATENT DOCUMENTS

| | | | |
|---|---|---|---|
| 4,206,534 | 6/1980 | Amstutz et al. | 445/8 |
| 4,415,932 | 11/1983 | Rogers | 348/822 |
| 5,188,553 | 2/1993 | Dougherty | 445/8 |

*Primary Examiner*—Donald J. Yusko
*Assistant Examiner*—Lawrence O. Richardson

[57] ABSTRACT

There are provided a cathode-ray tube display unit which can be manufactured with reduced weight and cost and which can have a screen plane flattened without the use of any metal band, and a method of making the same. The screen panel is previously deformed by the use of a jig and then sealingly connected to a funnel. After the jig has been removed, the interior of the display tube body is extracted to form a vacuum. The display tube body is distorted by the extraction, but such a distortion can be corrected by deformations previously applied to the display tube body. Thus, the screen plane can be flattened without the use of any metal band.

3 Claims, 7 Drawing Sheets

CATHODE-RAY TUBE DISPLAY UNIT AND METHOD OF MAKING THE SAME

BACKGROUND OF THE INVENTION

1. Field of the Invention

The present invention relates to a cathode-ray tube display unit which can be manufactured with a reduced weight and with a flattened screen, such a display unit capable of being used In TV receivers and computer terminals, and a method of making such a display unit.

2. Description of the Related Art

FIGS. 1A, 1B, 1C and 1D illustrate a method of making a cathode-ray tube display unit. In these figures, reference numeral 2 denotes a complete panel which includes a panel glass, a fluorescent screen formed on the panel glass at the inner wall thereof and a color selecting mechanism suspended from the panel, such as a shadow mask. Reference numeral 3 designates a funnel which may be produced by applying graphite to the inner wall of the funnel glass. The complete panel 2 comprises a front display tube screen portion 2A and a side display tube panel portion 2B. The funnel 3 comprises a neck portion 4 extending backwardly from the back thereof, a frit seal portion 5 sealingly connecting between the complete panel 2 and the funnel 3, and an electron gun 8 sealingly mounted in the neck portion 4. Reference numeral 1 denotes a complete display tube body which includes the complete panel 2, the funnel 3 and the neck portion 4.

On manufacturing, the complete panel and funnel 2, 3 are first prepared, as shown in FIG. 1A. The complete panel and funnel 2, 3 are then sealingly connected to each other through the frit seal portion 5 which is made of frit glass, as shown in FIG. 1B. The complete electron gun 8 is sealingly mounted in the hollow end of the neck portion 4. The resulting display tube body 1 is then extracted through a tip tube 10 to form a cathode-ray tube display unit which is a vacuum glass enclosure, as shown in FIG. 1C. Since the interior of the display tube body 1 is a vacuum, the side display tube panel portion 2B of the complete panel 2 will be distorted in a direction of broken-line arrow X while the front display tube screen portion 2A will be distorted in a direction of broken-line arrow W. Under such a condition, the display tube body 1 is subjected to the activation of electrons and various tests. Since it is dangerous to leave the display tube body 1 as it is, however, the side display tube panel portion 2B of the complete panel 2 in the display tube body 1 is tightened by a metal band 9 to prevent an implosion, as shown in FIG. 1D. This completes the display tube body 1. At this time, as seen from FIG. 1D, the metal band 9 distorts the side display tube panel portion 2B of the complete panel 2 in a direction of solid-line arrow Z and also the front display tube screen portion 2A in a direction of solid-line arrow Y. The direction of solid-line arrow Z is opposite to the direction of broken-line arrow X while the direction of solid-line arrow Y is opposite to the direction of broken-line arrow W. Therefore, the distortion of the display tube body 1 due to the vacuum can be corrected by tightening the metal band 9.

FIGS. 2A and 2B illustrate a reduction of stress in the partial cross-section of the cathode-ray tube display unit which is manufactured through the process as shown in FIGS. 1A, 1B, 1C and 1D. A solid line in FIG. 2A shows the outline of the complete panel and funnel 2, 3 before the interior of the display tube body 1 is extracted. A broken line shows the outline of the complete panel and funnel 2, 3 after the interior of the display tube body 1 has been extracted. As will be apparent from FIG. 2A, the side display tube panel portion 2B bulges outwardly with the front display tube screen portion 2A being recessed inwardly, when the interior of the display tube body 1 is in vacuum. Thus, the metal band 9 is tightened about the side of the display tube body 1 to deform it into the position shown by the solid line. FIG. 2B shows the correction of distortion in another complete panel 2 which comprises a side metal portion 2C and a back metal portion 6. As will be apparent from FIG. 2B, such a complete panel 2 is also distorted as shown by a broken line when the interior of the display tube body 1 is extracted. However, such a distortion can be corrected by tightening the metal band 9 to deform the display tube body 1 as shown by a solid line.

In addition to the aforementioned process in which the complete panel and funnel 2, 3 are sealingly connected to each other with the electron gun 8 being sealingly mounted in the funnel 3 and the interior of the display tube body 1 is then extracted and subjected to the steps of preventing the implosion and distortion, there is also known another process of sealing between the complete panel 2 and the funnel 3, then treating the assembly for preventing the implosion and finally sealingly mounting the electron gun 8 in the display tube body. However, this also requires the metal band 9 for preventing the implosion.

The use of the metal band 9 about the side display tube panel portion 2B of the complete panel 2 increases the weight of the display tube body 1 and barely flattens the front display tube screen portion 2A. Since the cathode-ray tube display unit is entirely made of glass, it necessarily requires the metal band to strengthen the entire structure when the display tube body is extracted to form a vacuum. In order to correct the distortion and to prevent the implosion, the metal band is required even with a structure in which the glass body is partially strengthen by metal. Thus, the prior art could no further reduce the weight in the cathode-ray tube display unit and economically manufacture the cathode-ray tube display unit.

SUMMARY OF THE INVENTION

It is therefore an object of the present invention to provide a cathode-ray tube having a reduced weight and a flatter screen and a method of making such a cathode-ray tube.

To this end, the present invention provides a cathode-ray tube display unit comprising a screen panel part having a front flat screen portion, the screen panel part being previously sealed under a first deformation and at least partially corrected with respect to the first deformation by subjecting the screen panel part to a second deformation when an extraction is made under the sealed condition, and a funnel part sealingly connected to the screen panel part.

The present invention also provides a method of making a cathode-ray tube display unit, the method comprising the steps of:

(a) applying a force to a screen panel part to deform it;

(b) sealingly connecting the screen panel part to a funnel part while maintaining the deformation;

(c) removing the applied force; and (d) extracting the screen panel and funnel parts to form a vacuum to flatten the front screen portion of the screen panel part.

In the step (a), the screen panel part may be deformed to expand the side thereof outwardly.

If a portion of the screen panel part is initially as shown in FIG. 3A, a load is applied to the screen panel part at its central portion to deform it so that the side of the screen panel part is expanded outwardly. In FIG. 3B, a broken line shows a portion of the screen panel part before being deformed while a solid line shows the same portion of the screen panel part after being deformed. After the screen panel part has been deformed into such a configuration, it is sealingly connected to the funnel part and the applied load is removed. FIG. 3C shows such a sealing connection between the screen panel and funnel parts. When the load is removed, the screen panel part tends to return to its original configuration so that the side of the screen panel part will be recessed inwardly. In FIG. 3C, a broken line shows the outline of the screen panel part before it is sealingly connected to the funnel part while a solid line shows the outline of the sealingly connected screen panel part. As the interior of the cathode tube is extracted to form a vacuum under such a condition, the front screen portion is distorted inwardly as shown in FIG. 3D. On the other hand, the side of the screen panel part is distorted outwardly to flatten the front screen portion. In FIG. 3D, a broken line shows the outline of the screen panel part before the extraction is made while a solid line shows the outline of the screen panel part after the extraction.

DETAILED EMBODIMENT OF THE PREFERRED EMBODIMENTS

Figure 1A:
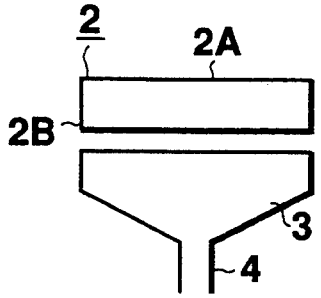
Fig. 1A RELATED ART
FIGS. 1A, 1B, 1C and 1D illustrate a process of making a cathode-ray tube display unit according to the prior art.
Figure 1B:
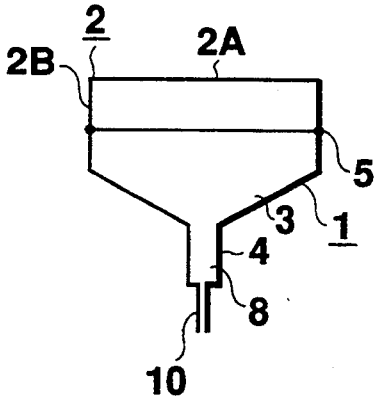
Fig. 1B RELATED ART
Figure 1C:
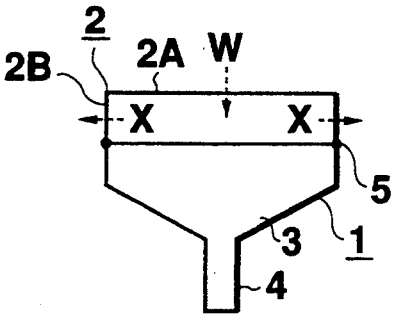
Fig. 1C RELATED ART
Figure 1D:
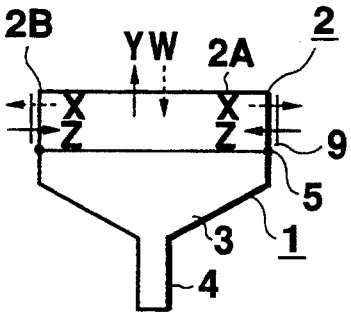
Fig. 1D RELATED ART
Figure 2A:
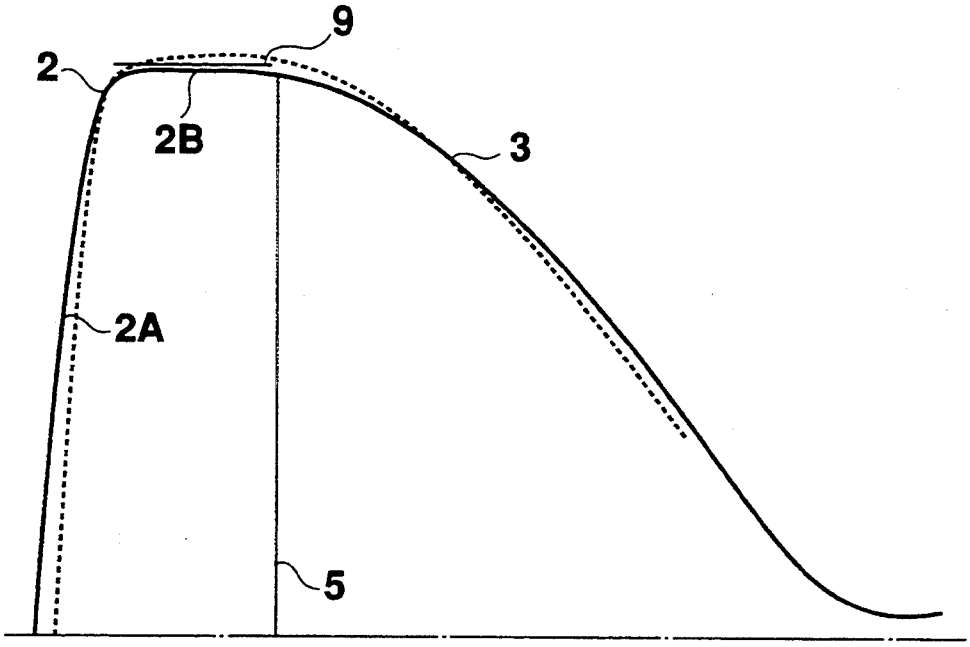
Fig. 2A RELATED ART
FIGS. 2A and 2B illustrate a distortion in the cathode-ray tube display unit constructed in accordance with the prior art.
Figure 2B:
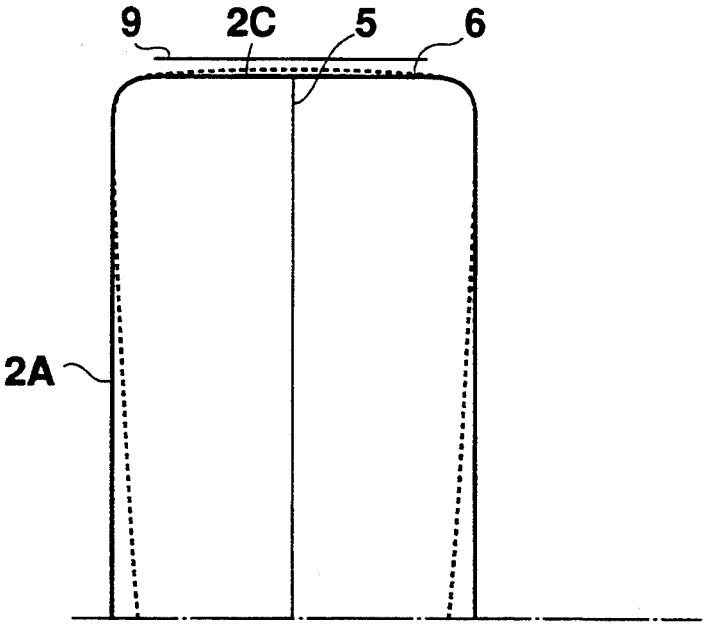
Fig. 2B RELATED ART
Figure 3A:
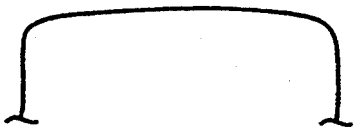
FIGS. 3A, 3B, 3C and 3D illustrate a process of making a screen panel part according to the present invention.
Figure 3B:
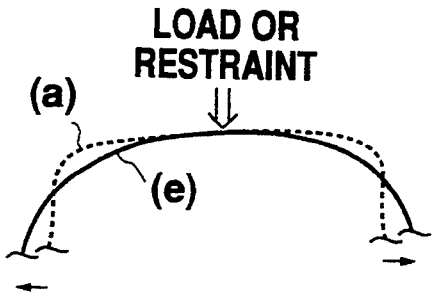
Figure 3C:
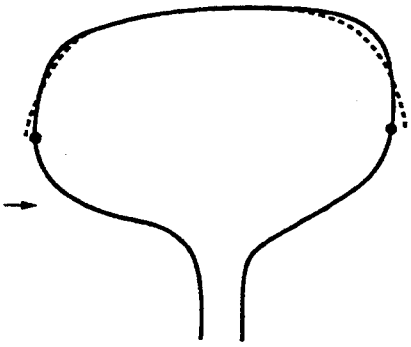
Figure 3D:
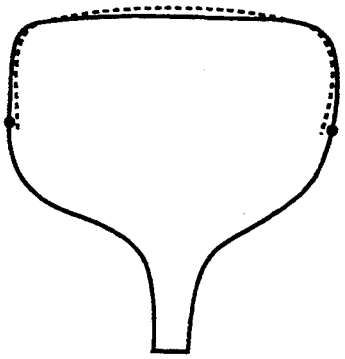
Figure 4:
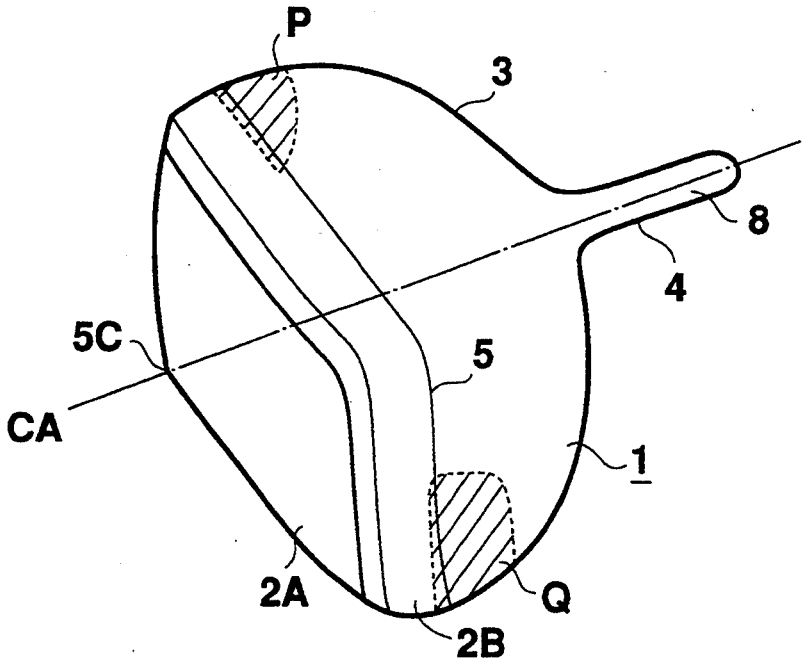
FIG. 4 is a partial and perspective view of one embodiment of a cathode-ray tube display unit constructed in accordance with the present invention.

Referring first to FIG. 4, there is shown a display tube body 1 of the present invention which comprises a complete panel 2 including a front display tube screen portion 2A and a side display tube panel portion 2B, a funnel 3 connected to the complete panel 2, and a neck portion 4 containing an electron gun 8. The connection between the complete panel 2 and the funnel 3 is sealed by a frit seal portion 5. FIG. 4 shows only the first quadrant of the cathode-ray tube display unit as viewed from a central axis CA passing through the center SC of the front display tube screen portion 2.A.

As will be apparent from FIG. 4, there is no metal band about the periphery of the side display tube panel portion 2B. Thus, the weight of the display tube body 1 can be reduced. Regions P and. Q are subjected to increased tensile stress when the interior of the display tube body 1 is extracted to form a vacuum. However, these regions have previously been deformed on manufacture. Even if there is no metal band, therefore, the front display tube screen portion 2A and side display tube panel portion 2B are corrected with respect to their distortions.

Figure 5A:
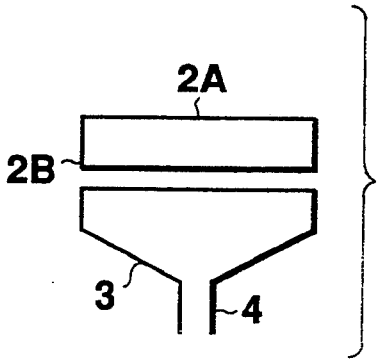
FIGS. 5A, 5B, 5C, 5D and 5E illustrate a process of making the cathode-ray tube display unit shown in FIG. 4.
Figure 5B:
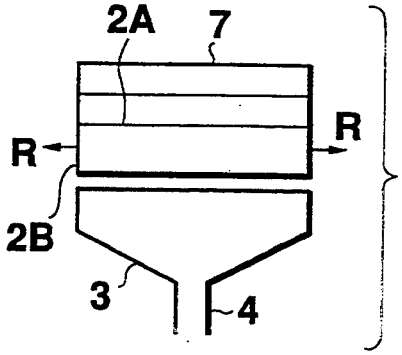
Figure 5C:
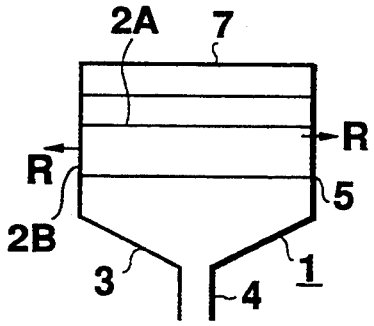
Figure 5D:
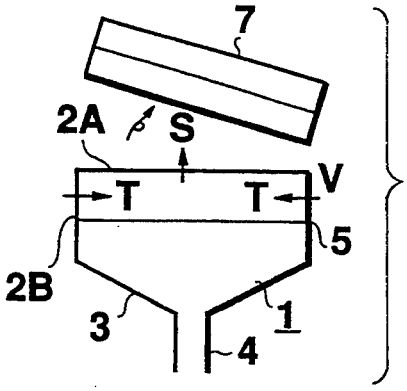
Figure 5E:
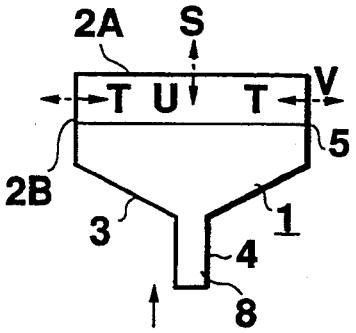

A process of making such a display tube body 1 will be described with reference to FIGS. 5A, 5B, 5C, 5D and 5E. The complete panel 2 and funnel 3 are first prepared, as shown in FIG. 5A. A jig 7 is then used to deform the side display tube panel portion 2B of the complete panel 2 outwardly at its longer and shorter sides in a direction of solid-line arrow R, as shown in FIG. 5B. The complete panel 2 is then sealingly connected to the funnel 3 through the frit seal portion 5 while the jig 7 is being mounted on the side display tube panel portion 2B, as shown in FIG. 5C. Thereafter, the jig 7 is removed, as shown in FIG. 5D. Since the externally directed forces are removed from the complete panel 2 by the removal of the jig 7, the side display tube panel portion 2B of the complete panel 2 will be distorted in a direction OF solid-line arrow T while the front display tube screen portion 2A will be distorted in a direction of solid-line arrow S. Thereafter, as shown in FIG. 5E, the electron gun 8 is sealingly mounted in the neck portion 4 and the interior of the display tube body 1 is extracted into vacuum and sealed to complete a cathode-ray tube display unit. At this time, the side display tube panel portion 2B of the complete panel 2 will be distorted by a force applied thereon in a direction of broken-line arrow V while the front display tube screen portion 2A will be distorted by a force applied thereon in a direction of broken-line arrow U. Such distortions tend to correct the deformations of the side display tube panel portion 2B and front display tube screen portion 2A in the directions T and S, respectively. Therefore, the stress in the respective portions 2A and 2B can be reduced.

By manufacturing the cathode-ray tube display unit in such a manner as has been described, no metal band is required to tighten the periphery of the side display tube panel portion 2B. In addition, the front display tube screen portion 2A can be flattened while reducing the weight of the display tube body 1.

Figure 6A:
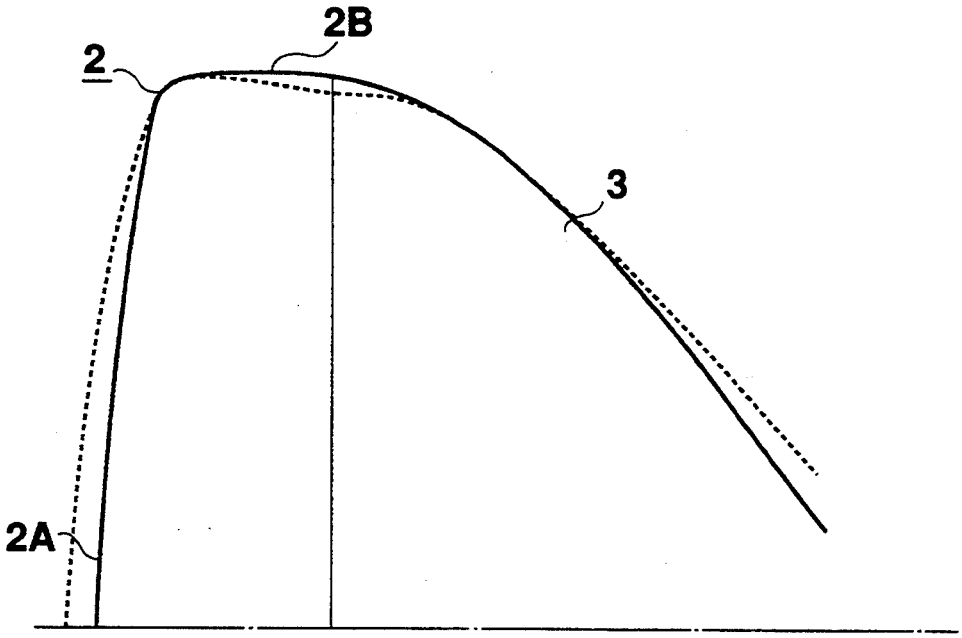
FIGS. 6A and 6B illustrate a distortion in the cathode-ray tube display unit shown in FIGS. 4 and 5.
Figure 6B:
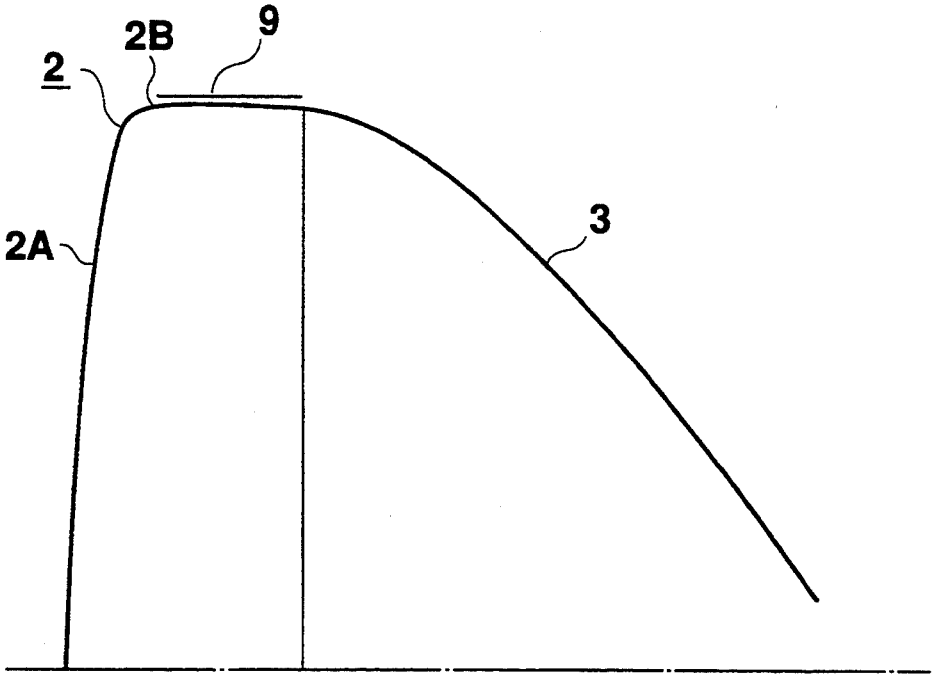

FIGS. 6A and 6B illustrate a reduction of stress in the cathode-ray tube display unit produced according to the process shown in FIGS. 5A, 5B, 5C, 5D and 5E. In FIG. 6A, a broken line shows the outline of the complete panel and funnel 2, 3 before the interior of the display tube body 1 is extracted to form a vacuum while a solid line shows the outline of the complete panel and funnel 2, 3 after the interior of the display tube body 1 has been extracted to form a vacuum. In the complete panel 2 which has previously been stressed outwardly, the side display tube panel portion 2B is inwardly recessed and the front display tube screen portion 2A is outwardly bulged, before the interior of the display tube body 1 is extracted to form a vacuum. After the interior of the display tube body 1 has been extracted, the side display tube panel portion 2B of the complete panel 2 is outwardly bulged and the front display tube screen portion 2A is inwardly recessed, as shown by solid line. As a result, the deformations of the complete panel and funnel 2, 3 will be eliminated. Consequently, the front display tube screen portion 2A can be flattened without tightening the side display tube panel portion 2B by a metal band.

However, a metal band 9 may be tightened about the periphery of the side display tube panel portion 2B of the complete panel 2. In such a case, the metal band 9 serves to clear any standard for safety or the like, rather than to correct distortion. Therefore, the metal band 9 may be of a simplified structure having a reduced weight.

Figure 7:
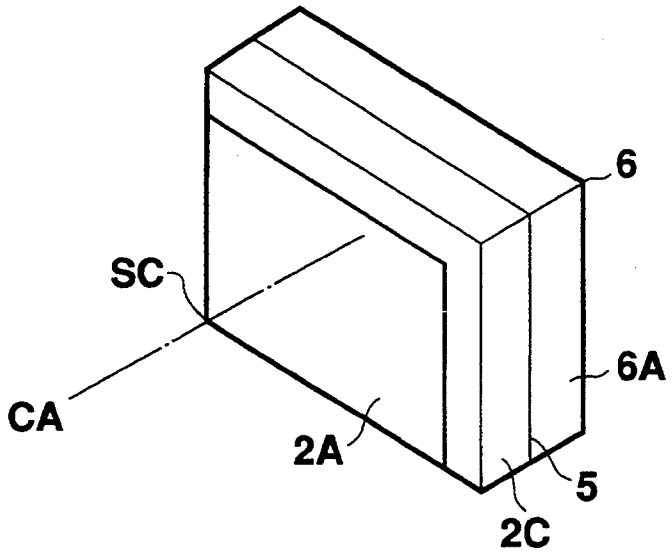
FIG. 7 is a partial and perspective view of the other embodiment of a cathode-ray tube display unit constructed in accordance with the present invention.

FIG. 7 is a perspective view of the other embodiment of a cathode-ray tube display unit constructed in accordance with the present invention. The cathode-ray tube display unit comprises a complete panel 2 having its side defined by a side metal portion 2C and a back metal portion 6 connected to the back of the complete panel 2. In such an arrangement, an outward force is previously applied to the complete panel 2 and side metal portion 2C. Under such a condition, the complete panel 2 is sealingly connected to the back metal portion 6 through a frit seal portion 5 to form a display tube body 1. When the interior of the display tube body 1 is extracted to form a vacuum, the previously applied deformations can be corrected. Since all the portions other than the front display tube screen portion 2A are mainly made of metal, the side metal portion 2C can be expanded outwardly in a relatively simple manner. This facilitates correcting the distortions due to the vacuum.

Although the embodiments have been described in connection with the process in which all the distortions due to the vacuum are absorbed by the deformations previously made in the complete panel, the present invention may be applied to a modified process in which part of the deformations due to the vacuum is absorbed by the deformations previously applied to the complete panel and the remaining deformations are absorbed by tightening a metal band. In such a case, the metal band may bear only part of the correction of deformation. Therefore, the cathode-ray tube display unit can be produced with a reduced weight. On the other hand, the front display tube screen portion can more reliably be flattened.

In accordance with the present invention, any distortion created when the interior of the display tube body is extracted to form a vacuum on manufacture can be absorbed by the deformations previously applied to the display tube body in the opposite direction. In comparison with the use of a metal band after the display tube body has been extracted to form a vacuum, therefore, the cathode-ray tube display unit of the present invention can been produced with a reduced weight and the front display tube screen portion can more simply be flattened. Even if a metal band is used, it may be of a simplified structure having a reduced weight. Therefore, the present invention can produce the cathode-ray tube display unit more economically.

We claim:

1. A cathode-ray tube display unit comprising;

a funnel part; and a screen panel part having a front flat screen portion and a side display tube panel portion sealingly connected to said funnel part, said screen panel part being sealed under a first deformation which deforms said side display tube panel portion in an inwardly curved configuration; said front flat screen portion being deformed in an outwardly curved configuration and corrected with respect to said first deformation by subjecting the screen panel part to a second deformation such that said front flat screen portion is rendered substantially flat due to atmospheric loading on said front flat screen portion when evacuated under the sealed condition, and wherein said side display tube panel portion of said screen panel part is deformed outwardly by applying force to said screen panel part prior to sealingly connecting to said funnel part, and said side display tube panel portion is connected to said funnel part while maintaining said force applied to said screen panel part.

2. The cathode-ray tube display unit of claim 1, further comprising:

band means for tightening said side display tube panel portion to correct a remaining deformation after gas is being evacuated.

3. A method of making a cathode-ray tube display unit having a screen panel part including a front screen portion and a side display tube panel portion, and a funnel part, comprising the steps of:

applying force to said screen panel part to deform said side display tube panel portion outwardly and said front screen portion inwardly;

sealingly connecting said side panel portion to said funnel part while maintaining said deformation;

removing said force so as to deform said side display tube panel portion inwardly and said front screen portion outwardly;

extracting to form vacuum inside a space defined by said screen panel part and said funnel part to flatten said front screen portion to correct the deformation caused by said removing step; and tightening a peripheral of said side display tube panel portion to correct a remaining deformation after said extraction.

* * * * *